US005394619A

United States Patent [19]

Kaplan

[11] Patent Number: 5,394,619

[45] Date of Patent: Mar. 7, 1995

[54] PORTABLE CLOTHES DRYER AND ROOM HUMIDIFIER

[76] Inventor: Bruce E. Kaplan, P.O. Box 34, Glenwild Rd., Woodridge, N.Y. 12789

[21] Appl. No.: 213,092

[22] Filed: Mar. 14, 1994

[51] Int. Cl.[6] ..... F26B 19/00

[52] U.S. Cl. ..... 34/90; 34/104; 34/239

[58] Field of Search ..... 34/90, 91, 151, 239, 34/104, 105, 106; 211/37, 38

[56] References Cited

U.S. PATENT DOCUMENTS

| | | | |
|---|---|---|---|
| D. 208,372 | 8/1967 | Spangle | D49/1 |
| 1,590,143 | 8/1926 | Williams . | |
| 3,449,838 | 6/1969 | Chancellor, Jr. | 34/90 |
| 3,626,602 | 12/1971 | Glowacki | 34/239 |
| 3,798,788 | 3/1974 | Kuntz | 34/104 |
| 3,835,552 | 9/1974 | Lord | 34/151 |
| 3,866,336 | 2/1975 | Bereza | 34/104 |
| 4,085,519 | 4/1978 | Masika | 34/104 |
| 4,136,464 | 1/1979 | Hay | 34/104 |
| 4,200,993 | 5/1980 | Blanc et al. | 34/104 |
| 4,429,928 | 2/1984 | Sullivan | 312/31 |
| 4,596,078 | 6/1986 | McCartney | 34/239 |
| 4,727,656 | 3/1988 | Jannach et al. | 34/104 |
| 4,856,206 | 8/1989 | Klein | 34/239 |
| 4,873,773 | 10/1989 | Canonge | 34/90 |
| 5,199,188 | 4/1993 | Franz | 34/104 |

*Primary Examiner*—Denise L. Gromada
*Attorney, Agent, or Firm*—Sandra M. Katin

[57] ABSTRACT

A clothes dryer designed to rest over the register of a floor duct delivering hot air from a forced hot air heating system. The dryer is a vertical hollow column, closed at the top and open at the bottom, to which are attached one or more foldable drying racks on which the clothes are hung for drying. Openings in the column at specified levels are fitted with baffles which direct the hot air toward the clothes. A flat base stabilizes the unit so it can remain in vertical orientation. A second embodiment has a housing beneath the base dimensioned to fit within the hot air duct when the register is removed. The drying racks can be easily folded down for storage.

5 Claims, 2 Drawing Sheets

PORTABLE CLOTHES DRYER AND ROOM HUMIDIFIER

FIELD OF THE INVENTION

The instant invention relates to a portable clothes drying unit which can be placed over the floor duct of a forced hot air heating system to utilize the hot air entering a room to dry clothes without curtailing the circulation of the hot air into the room.

BACKGROUND OF THE INVENTION

Hot air has long been utilized to dry clothes. Hot air dryers have been constructed in which the clothes are tumbled to aid in the ability of the hot air to circulate throughout the items of clothing placed in the drying chamber. Such clothes dryers have been further modified to direct the hot air into a garment bag in which clothes which might be damaged by the tumbling action can be hung for drying. (See U.S. Pat. Nos. 3,197,886 and 3,417,481)

For use by travelers, garment bags have been modified to accept the nozzles from portable hair dryers as a source of hot air to dry clothes as noted in U.S. Pat. Nos. 2,975,529 and 4,572,364.

Chancellor, Jr., in U.S. Pat. No. 4,429,928 teaches a room heating unit to be mounted in the wall and which is a combination heater and drying cabinet. The hot air can be directed into the room, into the drying cabinet and then out into the room, or the hot air can be directed into a nozzle attachment to be used as a hair dryer.

There have been several inventions which utilize hot air from a forced air heating unit or furnace to dry clothes. Spangle (Des. 208,372) designed a register for mounting over a wall hot air duct. The register has a single bar drying rack attached over which clothes can be hung to be dried in front of the register.

Williams (U.S. Pat. No. 1,590,143) teaches an insulated cabinet, closed on the top and on the four sides, but open on the bottom, with drying racks inside. The cabinet can also be constructed with double walls having an air space between them. The invention is placed over a floor register and the hot air is directed into the cabinet where clothes are hung for drying. The heat and moisture are trapped inside. When this device is used all of the hot air is directed into the cabinet and none is permitted to enter the room.

Canonge (U.S. Pat. No. 4,873,773) teaches a closed garment bag, constructed of vinyl or other non-porous, material which can be connected by way of a flexible non-porous duct to a hot air register. The hot air is directed into the bag where clothes are hung for drying. The air exits the bag by way of seams and the zipper closing. A porous fabric may also be used and the air can exit through the pores in the fabric. The hot air is directed into the bag and is not utilized to heat the room. The bag is specifically designed such that there is only a limited outflow of heat and moisture.

Sullivan has developed a three-sided bottomless covered structure to be hung on the outside of a motor home just above the propane gas vent. The hot gases exiting the vent are directed upward into the structure where clothes can be hung for drying. The heated exhaust gases directed toward the clothes may contain components which can impart undesirable odors to the clothes. (U.S. Pat. No. 4,429,928).

Today, with the high cost of fuel and dwindling supplies, there is a need for a portable drying unit which can be placed over a hot air register to utilize the hot air being expelled into the room to dry clothes without preventing the hot air from circulating into the room and, additionally, to add needed humidity to the air in the room.

BRIEF SUMMARY OF THE INVENTION

Many residences and most mobile and modular homes use forced hot air heating systems whereby the air enters a room through a register located in the floor. Since heating costs take up a major portion of household budgets it is desirable to further utilize the hot air entering the rooms to dry clothes. It is also a problem with forced hot air heating systems, especially in very cold climates, to keep the air properly humidified. By drying clothes in a room, moisture is added to the ambient air.

Usually, additional energy is used to dry clothes in conventional dryers heated by electricity or gas. Such dryers also dry the clothes by tumbling them, an action which may not be appropriate to all garments. Outdoor clothes lines are seen less and less, and can't be used during the winter months in a large portion of the country. There is a need for a device which can be used to dry clothes, which does not diminish the hot air entering the room and which uses no additional energy and therefore incurs no cost above that needed and already being expended to heat the home. There is additional need to increase the humidity in homes during the winter months.

It is an object of the present invention to provide a means to dry clothes which utilizes a source of forced hot air already present in the home.

It is a further object of the present invention to so utilize the hot air while still permitting it to enter and circulate freely in the room with little or no diminishment.

It is a still further object of the present invention to provide a source of added humidity to the room while drying the clothes.

A still further object of the present invention is to enable clothes to be dried without the expenditure of additional energy or funds above those already required to heat the residence.

Another object of the present invention is to have a portable unit which is easily and quickly set up and taken down, and which requires minimum storage space.

A further object of the present invention is to provide a drying unit that is inexpensive to manufacture.

The present invention can be used in place of a conventional tumbler-type clothes dryer, to supplement that type of clothes dryer, or for use with clothes that cannot be tumbled. It can be used daily for small items such as lingerie or children's clothing. When in use, the present invention will help maintain interior humidity while assisting with the household tasks and will not cause a diminishment in the quantity of heat entering the room.

The clothes dryer of the present invention is a vertically oriented hollow column with a flat base for stability. The column is closed on the top, has openings in the sides through which the forced hot air passes into the room, and baffles which direct the hot air toward the clothes. Drying racks are attached to the column and are arranged above the baffles so that clothes hung on the racks receive the hot air. The unit is placed over the floor duct of a forced hot air heating system.

DETAILED DESCRIPTION OF THE INVENTION

Figure 1:
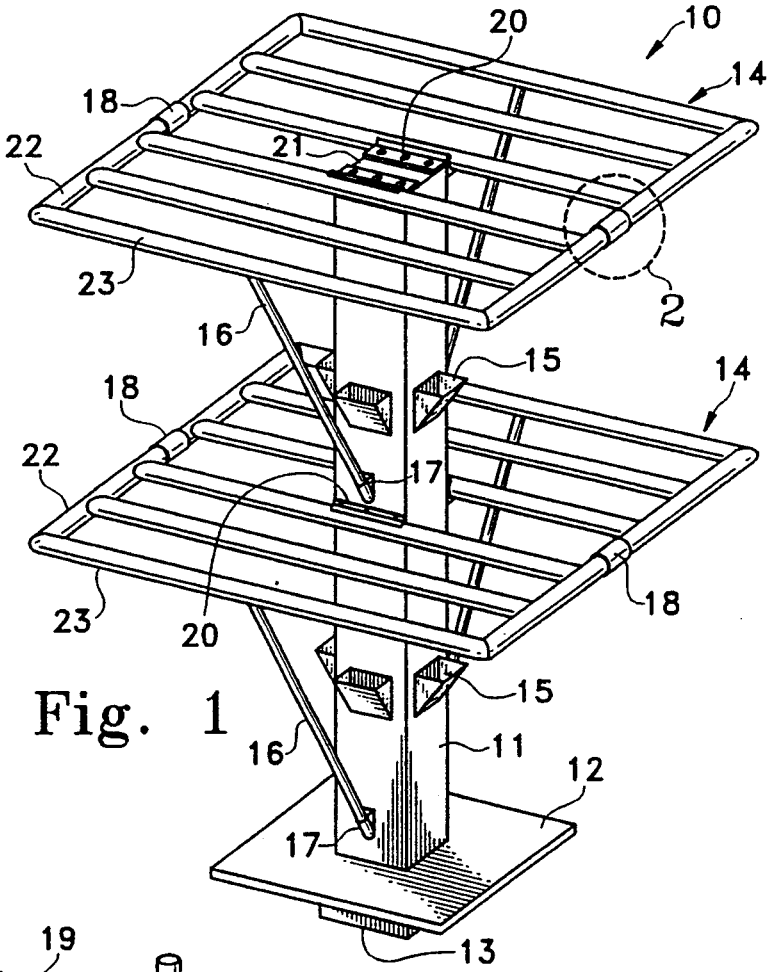
FIG. 1 is a perspective view of the hot air clothes dryer ready for use.

The hot air clothes dryer 10 of the instant invention as seen in FIG. 1 is a single unit that has a vertical central hollow column 11 that is opened at the bottom and has a sealed panel 21 covering the top. The column is permanently mounted in a flat base 12 that is considerably larger in area than the cross-section of the column and provides stability so the unit remains upright. The base has a central opening 25 communicating with the open bottom of the column.(See FIG. 6)

There are two embodiments of the instant invention. In one embodiment a rectangular housing 13 is fixedly attached to the underside of the base 12. The housing 13 surrounds the opening 25 in the bottom of the base 12 and is dimensioned to fit inside a floor hot air duct when the register is removed. This housing 13 can be seen in FIGS. 1, 3, 5 and 6. A second embodiment does not have this housing and can be seen in FIG. 7. Instead, there is a frame 26 about the periphery of the base 12 and extending below it. The frame 26 lifts the base off the floor. The unit of the second embodiment is placed over the hot air duct with the register in place. The frame is dimensioned to completely surround the register so that all of the hot air can circulate beneath the base and enter the column 11 through opening 25. The frame 26 also provides better stability than if the flat base rested directly on the register.

Figure 6:
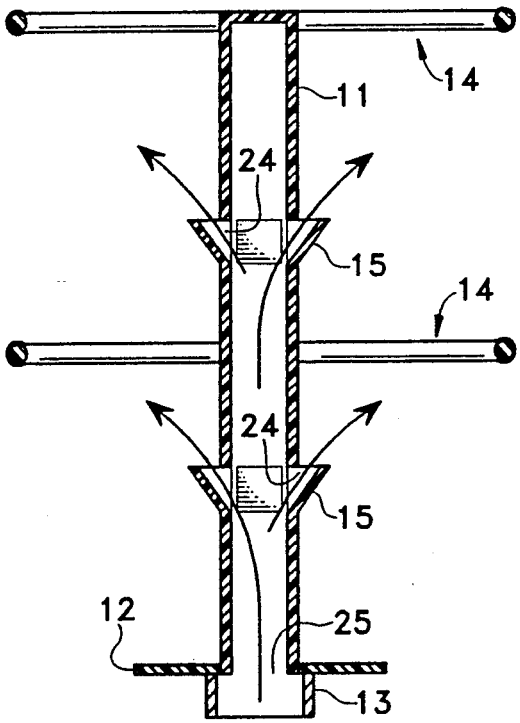
FIG. 6 is a cross-sectional view of the hot air clothes dryer through line 6—6 of FIG. 5.
Figure 5:
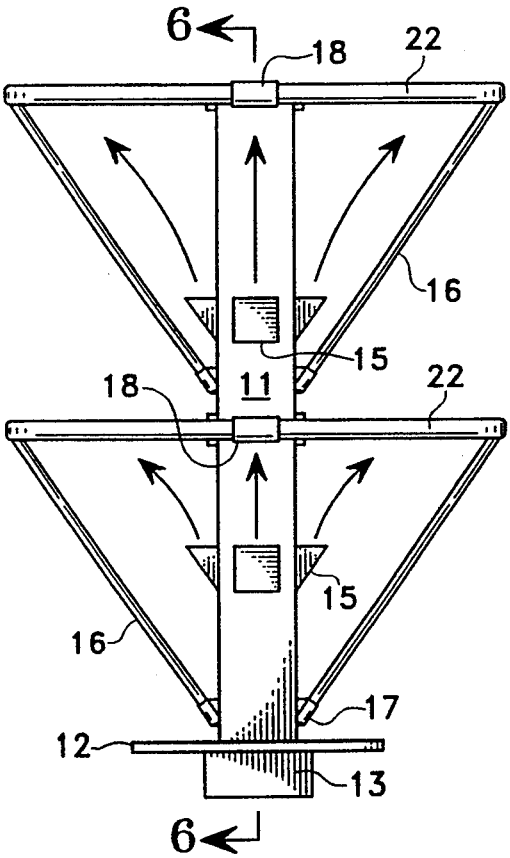
FIG. 5 is a side view of the hot air clothes dryer.
Figure 7:
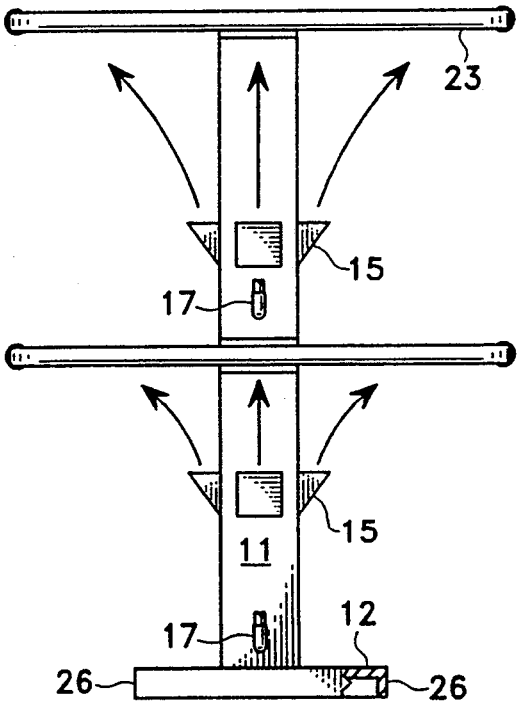
FIG. 7 is a side view 90° from the view of FIG. 5 and of a second embodiment of the hot air clothes dryer.

The hot air enters the dryer 10 from the bottom and exits the dryer through two sets of openings 24 that are symmetrically spaced about the column at two levels. (See FIG. 6) Surrounding each opening 24, on the outside of the column 11, is a baffle 15 oriented to direct the hot air upward and outward away from the column as illustrated in FIGS. 5, 6 and 7.

Figure 2:
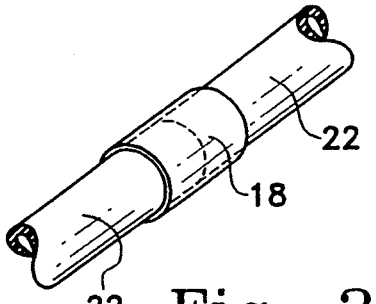
FIG. 2 is a close-up perspective view of the slide-connector used to fasten the two sections of the drying rack when it is in use.
Figure 3:
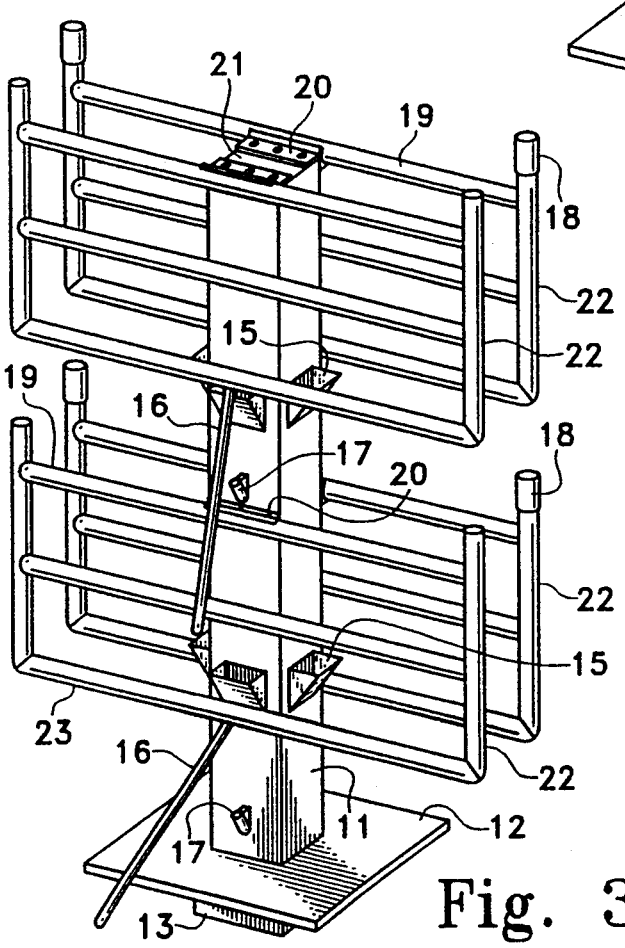
FIG. 3 is a perspective view of the hot air clothes dryer with the drying racks folded down for storage.
Figure 4:
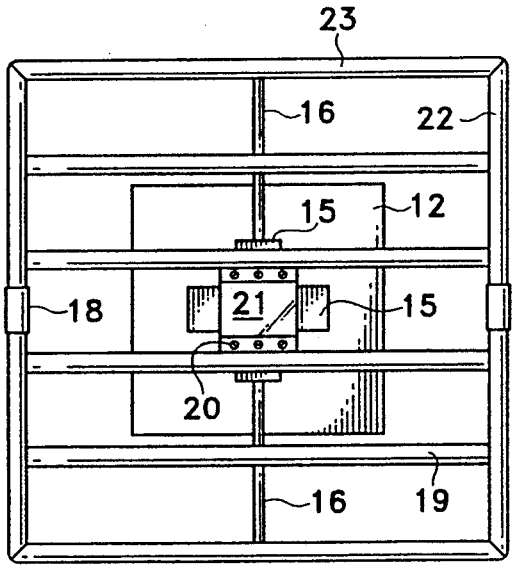
FIG. 4 is a top plan view of the hot air clothes dryer.

There are two rectangular foldable drying racks 14 fixedly attached to the column 11. Each rack 14 consists of a rectangular frame with several evenly spaced parallel rods 19 permanently attached to two opposite sides 22 as seen in FIG. 4. These same two sides 22 are divided in the center. A slidable tubular connector 18 maintains the continuity and rigidity of each of the sides 22 when the dryer 10 is in use. (FIGS. 1, 2 and 4) The other two opposite sides 23 are continuous. Hinges 21 attached to the rods adjacent to the column are the means by which the racks 14 are attached to the column 11 and enable the racks to fold down. When the dryer 10 is not in use, the racks are folded down by sliding the connectors 18 to one side and lowering each half of the racks on their respective sides of the column 11. The folded dryer 10 can be seen in FIG. 3.

To add stability to the racks, support poles 16 are hingedly affixed at the center of each continuous side 23. The free end of each support pole 16 fits into a support rest 17 located below the baffle on the same side of the column 11. When the rack is folded down, the free end of the support pole 16 is removed from the rest 17 and is permitted to hang down from the folded rack 14. (See FIG. 3) Other means known in the art to support the racks may be utilized.

One rack is located at the top of the column 11 and the second at about midway down its length. The racks 14 are oriented such that hot air exiting the openings 24 and through the baffles 15 is directed toward clothes hung on the racks. (See FIGS. 5, 6 and 7)

The clothes dryer of the instant invention can be of varying dimensions, which will permit the use of one or more racks, depending on the amount of drying capacity desired. The illustrations showing two racks are in no way meant to limit the invention thereto.

The central hollow column 11 should be at least six inches square in cross-section for the best circulation of air therethrough. The base 12 should be at least eighteen inches square.

The hot air clothes dryer can be made of any lightweight rigid material. Polymers such as polystyrene and poly vinyl chloride are examples. The dryer can also be made of fiberglass whereby there will be less tendency toward distortion and degradation after prolonged exposure to heat. Metals such as aluminum are less desirable because of possible chemical reactions with bleach or detergent residues remaining on the clothes. Metals will also absorb heat that is better disseminated to the clothes and into the room.

The clothes dryer is easy to set up and requires little storage space when the racks are folded down. It can be placed in a closet or out of the way against a wall and is quickly set up over the hot air register when needed. The dryer can be set up and used by children as well as adults and provides a means to teach even young children to assist in caring for their own clothes and to help with household tasks.

The hot air from the floor duct passes through the column 11, but most of the hot air exits the column through the openings 24 and enters the room, so that use of the hot air clothes dryer of the instant invention does not take heat from the room in which it is being used. As the clothes are dried, the water evaporating therefrom adds needed humidity to the air in the room.

When the unit is not being used to dry clothes it can function as a room humidifier by hanging wet towels or other wet cloths on the rack. Again this method of humidifying a room uses no additional energy and there are no parts to corrode or wear out as often occurs with various types of room humidifiers.

While two embodiments of the instant invention have been illustrated and described in detail it is to be understood that this invention is not limited thereto and may be otherwise practiced within the scope of the following claims.

I claim:

1. A clothes dryer for use over a source of forced hot air used to heat a room, said clothes dryer comprising:

a rigid vertical tubular support having an interior and an exterior and a top and a bottom, said tubular support being open at the bottom for entrance of the hot air;

panel means sealed to the top of said tubular support to prevent the exit of hot air through the top;

outlet means in said tubular support through which the hot air can exit, said outlet means defining multiple openings therethrough;

baffle means situated on the exterior of said tubular support adjacent said outlet means, said baffle means oriented to direct the exiting hot air outward into the room so as not to diminish the quantity of hot air supplied and additionally to direct the exiting hot air upward toward the clothes to be dried;

stabilizing base means into which said tubular support is permanently disposed, said base means having a central opening contiguous with the open bottom of said tubular support for introduction of the hot air into the dryer; and clothes hanging means attached to said tubular support and oriented such that clothes hung on said hanging means receive the upward directed exiting hot air whereby said clothes are dried and moisture extracted therefrom is added to the hot air entering the room.

2. A clothes dryer for use over a duct fitted with a register through which forced hot air is vented into a room to heat said room, said clothes dryer comprising:

a rigid vertical tubular support having an interior and an exterior and a top and a bottom, said tubular support being open at the bottom for entrance of the hot air; panel means sealed to the top of said tubular support to prevent the exit of hot air through the top;

outlet means in said tubular support through which the hot air can exit, said outlet means defining multiple openings symmetrically arranged in at least one level in said tubular support;

baffle means situated on the exterior of said tubular support adjacent each of said openings to direct the exiting hot air outward into the room so as not to diminish the quantity of hot air supplied and additionally to direct the exiting hot air upward toward the clothes to be dried;

stabilizing base means into which said tubular support is permanently disposed, said base means having a central opening contiguous with the open bottom of said tubular support for introduction of the hot air into the dryer;

frame means surrounding said base means and extending below said base means, said frame means dimensioned to surround said register and to permit all of the hot air discharged through said register to circulate into said tubular support; and clothes hanging means attached to said tubular support and oriented such that clothes hung on said clothes hanging means receive the upward directed exiting hot air, whereby said clothes are dried and moisture extracted therefrom is added to the hot air entering the room.

3. A clothes dryer as in claim 2 wherein the clothes hanging means are foldable drying racks hingedly attached to the tubular support.

4. A clothes dryer for use over a duct through which forced hot air is vented into a room to heat said room, said clothes dryer comprising:

a vertical tubular support having an interior and an exterior and a top and a bottom, said tubular support being open at the bottom for entrance of the hot air; panel means sealed to the top of said tubular support to prevent the exit of hot air through the top; outlet means in said tubular support through which the hot air can exit, said outlet means defining multiple openings symmetrically arranged in at least one level in said tubular support;

baffle means situated on the exterior of said tubular support adjacent each of said openings to direct the exiting hot air outward into the room so as not to diminish the quantity of hot air supplied and additionally to direct the exiting hot air upward toward the clothes to be dried;

stabilizing base means into which said tubular support is permanently disposed, said base means having a central opening contiguous with the open bottom of said tubular support for introduction of the hot air into the dryer;

housing means affixed beneath said base means and surrounding the central opening, said housing means dimensioned to rest within the duct through which the hot air is vented into the dryer; and clothes hanging means attached to said tubular support and oriented such that clothes hung on said clothes hanging means receive the upward directed exiting hot air, whereby said clothes are dried and moisture extracted therefrom is added to the hot air entering the room.

5. A clothes dryer as in claim 4 wherein the clothes hanging means are foldable drying racks hingedly attached to the tubular support.

* * * * *